United States Patent [19]

Ortiz

[11] 4,134,228

[45] Jan. 16, 1979

[54] INFLATED TOY BALLOON LAUNCHER

[75] Inventor: Nilson V. Ortiz, San Francisco, Calif.

[73] Assignees: Nilson V. Ortiz; Francisco R. Rollojay, ; part interest to each

[21] Appl. No.: 756,590

[22] Filed: Jan. 3, 1977

[51] Int. Cl.[2] ..... A63H 3/06

[52] U.S. Cl. ..... 46/88; 124/41 R; 124/31; 124/57

[58] Field of Search ..... 124/25, 1, 27, 21, 57, 124/22, 37, 41 R, 16, 31; 46/74 B, 88, 89, 90; 273/106.5 R, 106.5 B

[56] References Cited

U.S. PATENT DOCUMENTS

| | | | |
|---|---|---|---|
| 1,852,401 | 4/1932 | De Camps | 124/37 X |
| 1,988,191 | 1/1935 | Donato | 124/26 |
| 2,401,868 | 6/1946 | Greenwood | 46/72 |
| 3,025,634 | 3/1962 | Barricks | 46/88 |
| 3,392,473 | 7/1968 | Dietsch | 124/27 X |
| 3,430,620 | 3/1969 | Davis | 124/41 R X |

FOREIGN PATENT DOCUMENTS

| | | | |
|---|---|---|---|
| 1330882 | 5/1963 | France | 46/74 B |

*Primary Examiner*—Richard C. Pinkham
*Assistant Examiner*—William R. Browne
*Attorney, Agent, or Firm*—Robert K. Rhea

[57] ABSTRACT

A projectile launching toy simulating a space gun, which has a generally flat disc-like body is provided with a forwardly biased shaft moved against spring tension by a trigger for releasing a projectile. The projectile comprises an inflated toy balloon having its opening frictionally engaging one end of a tube with the other end of the tube coaxially surrounding the head end of the shaft. Air released from the balloon through the tube when launched simulates a rocket. When the balloon is released a shaft is retracted from the mouth of the balloon by means of a trigger.

2 Claims, 4 Drawing Figures

INFLATED TOY BALLOON LAUNCHER

BACKGROUND OF THE INVENTION

1. Field of the Invention

The present invention relates to a toy rocket launching device and more particularly to a device simulating a space gun for releasing an inflated toy balloon to simulate a rocket or missile.

2. Description of the Prior Art

Prior patents generally disclose toy devices for imparting movement to rocket or missile simulating toy objects by a toy gun. These toy guns are usually provided with a trigger mechanism which is cocked against spring pressure and released by a trigger so that the potential energy, stored by the spring, is imparted to the toy object being launched.

This invention is distinctive over these patents by providing a launching device simulating a toy gun featuring a shaft biased forwardly of a body member to provide a head portion which frictionally receives one end portion of a tube inserted at its other end portion into the opening of an inflated toy balloon. Air under pressure in the balloon provides the motive force and escapes through the tube for moving the balloon in a rocket-like action when the movable shaft is withdrawn out of the balloon connected tube by a trigger moving the shaft head end into the body member.

SUMMARY OF THE INVENTION

A support handle equipped flat disk-like body is provided with a diametric groove open toward its perimeter opposite its handle for reciprocably receiving an elongated shaft. A spring normally biases the shaft in a direction opposite the handle to dispose a head end portion of the shaft outwardly of the body. A trigger, connected with the shaft, is reciprocable in a slot for moving the shaft head end portion into the body and limiting the exposed length of the head end portion of the shaft. An elongated tube, adapted to be frictionally received by the open end of a toy balloon, is frictionally received at its other end portion by the head end portion of the shaft so that movement of the shaft into the body launches an inflated balloon and its connected tube.

The principal object of this invention is to provide a space gun-type toy for launching an inflated toy balloon to simulate a missile or rocket.

DESCRIPTION OF THE PREFERRED EMBODIMENT

Figure 1:
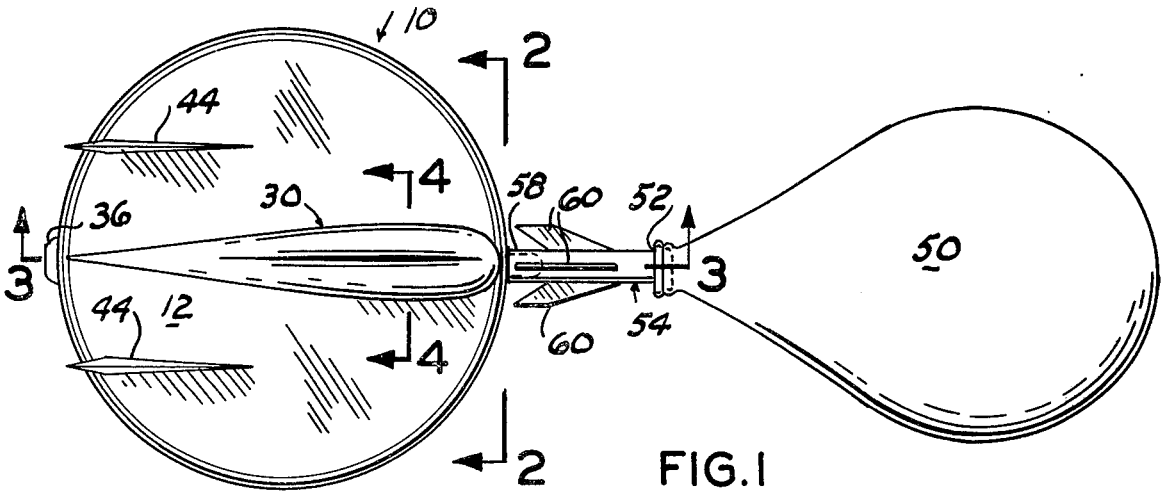
FIG. 1 is a top view of the launching device connected with an inflated toy balloon in position to be launched.
Figure 2:
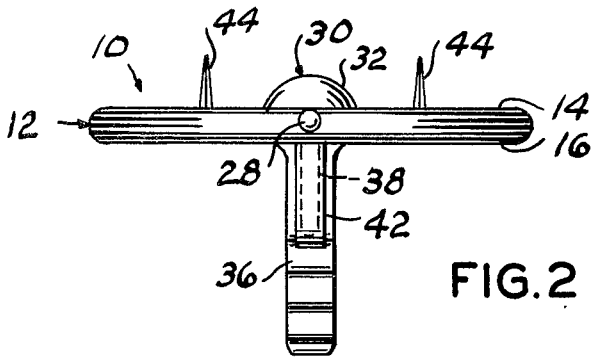
FIG. 2 is an elevational view of the launching device looking in the direction of the arrows 2—2 of FIG. 1; and, FIGS. 3 and 4 are fragmentary vertical cross sectional views, to a larger scale, taken substantially along the lines 3—3 and 4—4, respectively, of FIG. 1.

Like characters of reference designate like parts in those figures of the drawings in which they occur.

In the drawings

The reference numeral 10 indicates the launching device, as a whole, having the general appearance, in side elevation, of a toy gun. The device 10 is formed by a flat disk-like body 12 having parallel upper and lower surfaces 14 and 16, respectively. The body 12 is provided with a diametric upwardly open groove 18 extending at one end through the perimeter of the body and terminating at its opposite end in a shoulder 20 perpendicular to the upper and lower surfaces of the body. An elongated shaft 22 having a length substantially less than the length of the groove is slidably disposed within the groove 18. The diameter of the shaft 22, with respect to the transverse dimension of the groove 18, is such that its upper limit is disposed slightly below the plane of the upper surface 14 of the body for the purposes readily apparent.

A resilient member, such as a helical spring 24, is interposed between the shoulder 20 and the rearward end 26 of the shaft to normally bias the shaft forwardly so that its head end portion 28 projects beyond the periphery of the body a selected distance. The shaft 22 and spring 24 are maintained within the groove 18 by an elongated cockpit and passenger compartment simulating member 30 having a longitudinal and transverse arcuate upper surface 32 and a flat bottom surface 34 spanning and coextensive with the groove 18 and contiguously contacting the upper surface 14 of the body. A pistol grip-type handle 36 is secured in depending relation to the bottom surface 16 of the body below the position of the spring 24.

A trigger 38 is secured to the shaft 22 and depends beyond the bottom surface of the body 12 through an elongated slot 40 communicating with the groove 18 and projecting forwardly from the upper limit of the handle 36 a distance substantially equal to the combined length of the shaft head end portion 28 projecting beyond the body and the forward to rearward dimension of the trigger 38 so that the forward limit of the slot 40 forms a stop for the trigger and limits the forward movement of the shaft by the spring 24.

A trigger guard 42 is secured to the depending surface 16 of the body and the forward limit of the handle 36. The position of the trigger 38, with respect to the handle 36 when the shaft is biased forwardly by the spring 24 and with respect to the trigger guard 42, is preferably such that the forefinger of the user may be respectively disposed between the rearward surface of the trigger 38 and the forward limit of the handle 36 and the forward limit of the trigger 38 and the trigger guard 42 for the purposes presently explained.

As a decorative feature to further simulate a space gun the body 12 is provided with a pair of upstanding stabilizers or fins 44 secured to its upper surface in parallel spaced relation on opposite sides of the cockpit passenger member 30.

Figure 3:
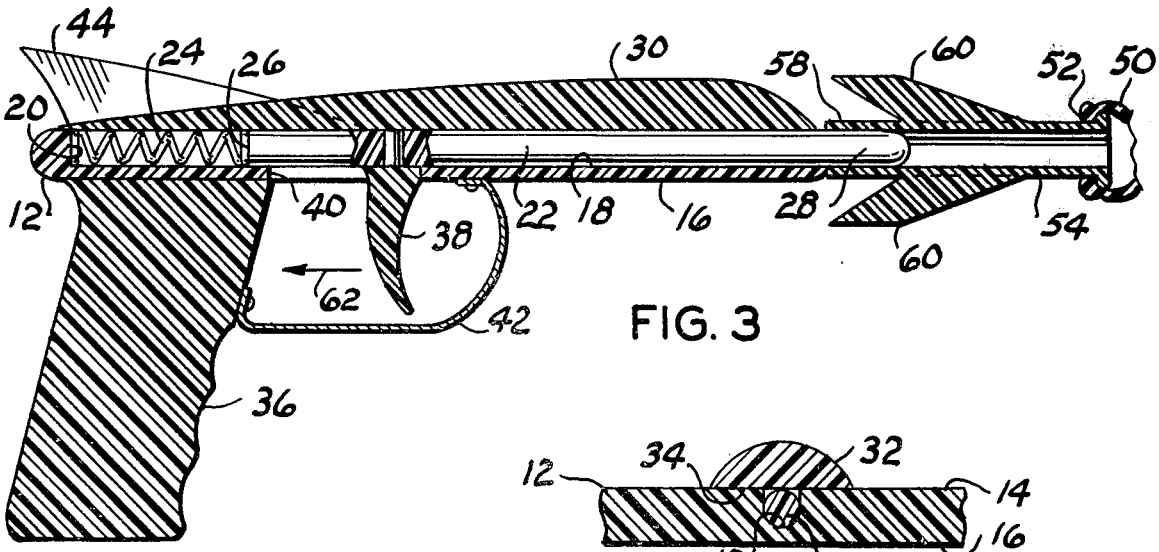
Figure 4:
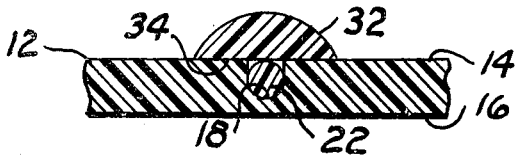

The reference numeral 50 indicates a conventional toy balloon having an open end 52. An elongated discharge tube 54 connects the balloon 50 to the launching device 10. The discharge tube is provided with an annular outstanding rib or flange (FIG. 3) on its forward end which is inserted into the open end 52 of the balloon 50 and is retained therein by the resiliency of the balloon material. The other end portion 58 of the discharge tube is dimensioned to frictionally surround the head end portion 28 of the shaft 22. The shaft head end portion thus forms an airtight plug for the tube 54. The discharge tube 54 is preferably provided with a plurality of outstanding vanes or fins 60 to simulate the discharge end of a missile or rocket.

Each of the components of the device, with the exception of the balloon, spring and trigger guard, is preferably formed from lightweight material, such as plastic or balsa wood.

Operation

In operation the tube flange is inserted into the open end of the balloon and the tube end portion 58 used as a mouthpiece for inflating the balloon. The tube end portion 58 is coaxially disposed on the head end 28 of the shaft. To do this the operator places his forefinger between the trigger 38 and handle 36 to maintain the head end 28 of the shaft projecting beyond the body 12 while placing the tube end portion 58 on the shaft. The operator them aims the gun-like launcher 10, by sighting along the passenger cockpit member 30, in a desired direction while holding the handle 36 and pulls the trigger 38 rearwardly in the direction of the arrow 62 with his forefinger so that the shaft 22 compresses the spring 24 and withdraws the shaft head end portion 28 from within the tube end portion 58 by the tube 54 abutting the adjacent peripheral portion of the body 12. Air contained by the balloon begins escaping through the tube 54 so that the balloon is moved in a generally forward usually erratic direction partially stabilized by the tube fins 60.

Obviously the invention is susceptible to changes or alterations without defeating its practicability. Therefore, I do not wish to be confined to the preferred embodiment shown in the drawings and described herein.

I claim:

1. A toy rocket launcher, comprising:

a body having a handle and having an elongated groove lying substantially in the plane of the body, and said groove being open at one end through a marginal surface of said body; said body being flat and disc-like an elongated shaft having a length substantially less than the length of the groove and being axially reciprocable therein and having a head end portion;

resilient means comprising a spring disposed within the other end portion of the groove for normally biasing said shaft head end portion beyond the open end of the groove;

toy rocket means releasably connected with said shaft head end portion, said toy rocket means including a toy balloon having an opening, and, a tube having one end portion disposed within the balloon opening, the other end portion of said tube coaxially surrounding said shaft head end portion in airtight relation when said balloon is inflated; and, trigger means for moving said shaft head end portion into said body.

2. The toy rocket launcher according to claim 1 in which said body is provided with a slot communicating with the groove and said trigger means comprises:

a trigger laterally connected with said shaft at its end portion opposite said head end portion and projecting through the slot adjacent said handle.

* * * * *